United States Patent [19]

Puterbaugh

[11] 3,948,407

[45] Apr. 6, 1976

[54] REFRIGERATED CABINET CONSTRUCTION

[75] Inventor: Richard L. Puterbaugh, St. Cloud, Minn.

[73] Assignee: Franklin Manufacturing Company, St. Cloud, Minn.

[22] Filed: June 27, 1973

[21] Appl. No.: 374,276

[52] U.S. Cl. ..... 220/4 R; 220/9 F; 220/9 G; 220/62

[51] Int. Cl.[2] F25D 23/06; B65D 7/28; B65D 25/18

[58] Field of Search ..... 220/4 R, 9 R, 9 F, 9 G, 220/10, 66, 67, 76, 77, 62; 312/214

[56] References Cited

UNITED STATES PATENTS

| | | | |
|---|---|---|---|
| 386,765 | 7/1888 | Atkinson | 220/77 |
| 1,493,376 | 5/1924 | Nelson | 220/4 R |
| 2,060,756 | 11/1936 | Forsthoefel | 220/9 G |
| 2,088,716 | 8/1937 | Money | 220/9 G |
| 2,173,970 | 9/1939 | Lagerholm | 220/67 |
| 2,180,886 | 11/1939 | Thomas | 220/62 X |
| 2,205,779 | 6/1940 | Forsthoefel | 220/9 G |
| 2,622,753 | 12/1952 | Philipp | 220/4 R |
| 3,151,767 | 10/1964 | Nakata | 220/77 |
| 3,752,350 | 8/1973 | Franck | 220/9 G |

FOREIGN PATENTS OR APPLICATIONS

| | | | |
|---|---|---|---|
| 837,385 | 6/1960 | United Kingdom | 312/214 |
| 1,362,178 | 4/1964 | France | 220/9 G |

*Primary Examiner*—William Price
*Assistant Examiner*—Stephen Marcus
*Attorney, Agent, or Firm*—McNenny, Farrington, Pearne & Gordon

[57] ABSTRACT

A disclosed refrigeration cabinet has an integrated construction of sheet material and insulating foam which substantially eliminates the need for mechanical fasteners and welding, minimizes assembly operations, and permits the use of prefinished sheet panels. An outer cabinet shell preferably includes a prefinished sheet wrapped into a rectangular tube. The shell tube is reinforced at one end by a perimeter frame and at the other end by a thermal breaker collar. After the shell tube and frame are assembled, a liner is positioned in the tube and the breaker collar is installed. Rigid insulating foam is then foamed in place between the shell and liner to produce a sandwich construction in which the foam secures and reinforces both the shell and the liner.

9 Claims, 6 Drawing Figures

Fig. 3
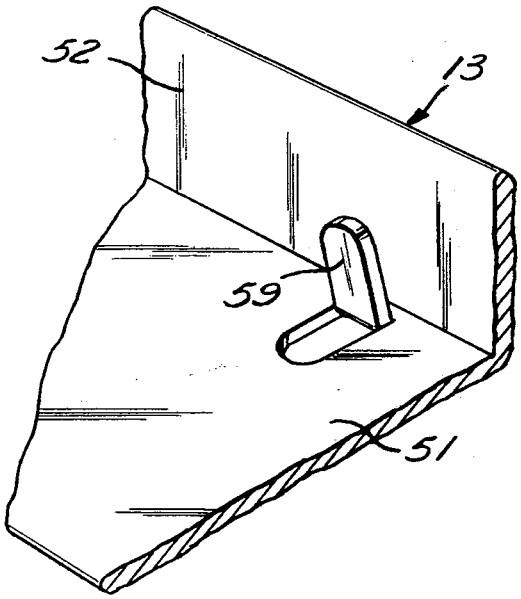
Fig. 5
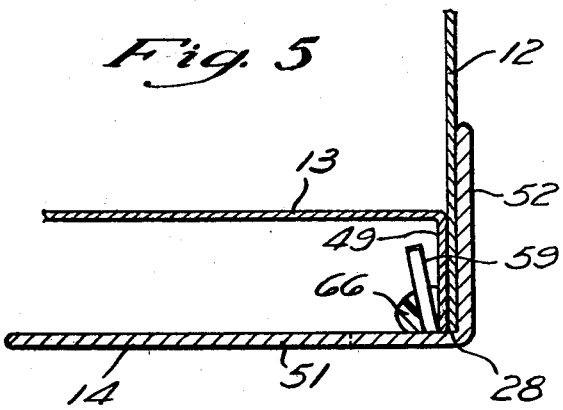
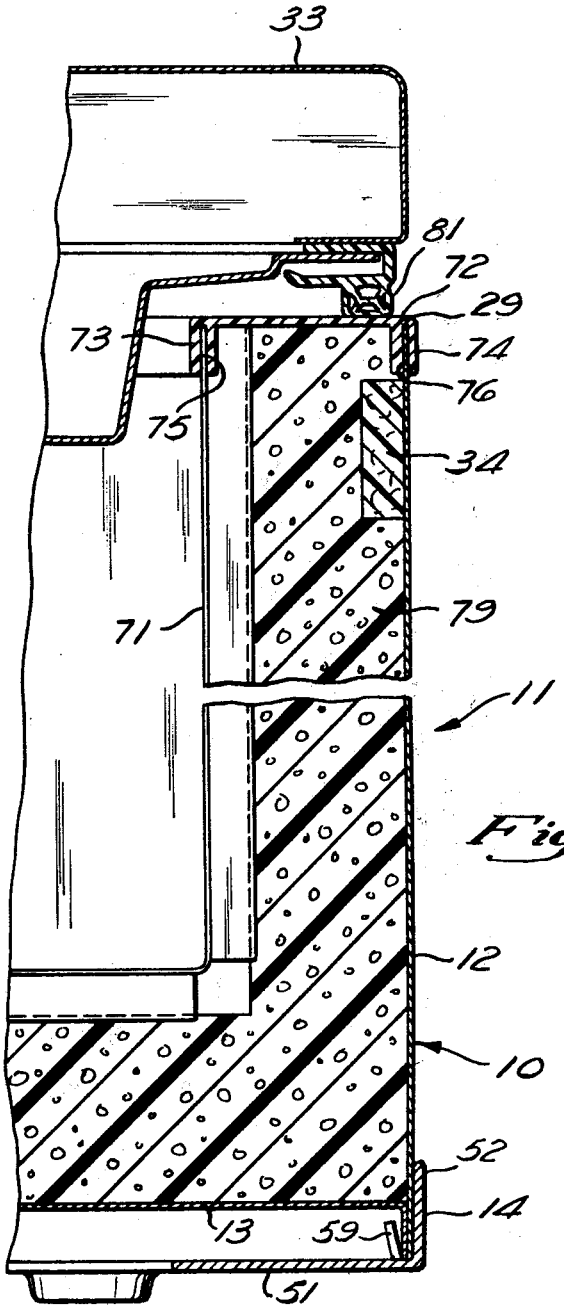
Fig. 6

REFRIGERATED CABINET CONSTRUCTION

BACKGROUND OF THE INVENTION

The present invention relates to the manufacture of refrigeration cabinets and, more particularly, to a cabinet construction which requires a minimum of assembly operations, labor, and number of components for its manufacture.

PRIOR ART

Refrigeration cabinet construction has generally involved the assembly, mostly by hand, of a substantial number of parts and components. Such parts and components have usually required numerous mechanical fasteners and/or welding operations for their final assembly, thereby compounding the necessary number of elements and operations. Besides adding incrementally to the cost of a product, numerous fastening and assembly operations in common use are generally not compatible with prefinished sheet materials. For example, mechanical fasteners and spot welding usually detract from the appearance of preapplied appearance coatings.

Rigid insulating foams of polyurethane or other plastic materials are widely used in recognition of their high insulating qualities. The structural and adhesive properties of such materials have had limited application in the field of refrigeration cabinet construction. Refrigeration apparatus utilizing these properties to some extent is proposed in U.S. Pat. Nos. 3,520,581 and 3,588,214, for example. For the most part, prior efforts using the structural and adhesive properties of insulating foams have not realized the full potential of such materials in eliminating structural components, mechanical fasteners, and assembly operations.

SUMMARY OF THE INVENTION

The invention provides a refrigeration cabinet construction in which panel forming sheet material and rigid insulating foam is structurally integrated in a manner whereby full advantage is made of the structural properties of these materials and whereby the number of elements and assembly operations in the manufacture of the cabinet are minimized.

An outer cabinet shell formed of sheet material preferably is reinforced by only two structural elements. A perimeter frame reinforces one face of the cabinet shell and also provides a convenient mounting for a motor compressor unit. An opposite face of the cabinet shell is reinforced by a thermal breaker collar which also serves to position and support an inner cabinet liner relative to the shell.

According to the invention, the shell, frame, and liner are permanently maintained in their assembled position by applying adhesive at strategic cabinet areas and foaming the rigid insulation in place between the liner and shell. The use of mechanical fasteners and welding operations is thereby eliminated in the assembly procedure. Thus, prefinished sheet material may be employed in the making of the shell without risking damage to its appearance otherwise caused by such fasteners or welding.

In the preferred embodiment, four sides of the outer cabinet shell are formed by a single sheet wrapped into a short rectangular tube. Returned edges of the wrapped sheet are joined at a seam which is self-locking under expansion of the foam insulation. The remaining edges of the sheet define the planes of the other two faces or sides of the box-like liner. The perimeter frame is roll-formed from flat stock to form an angle with one leg of the angle arranged to fit around and provide continuous external support for one of the remaining sheet edges. The other angle leg provides spaced locating tabs stamped from the plane of the leg which cooperate with the first angle leg to properly position the wrapped sheet in the frame prior to foaming of the insulation. Also received in these tabs is an additional panel sheet forming a fifth side of the outer shell. The wrapped sheet and additional panel sheet are secured together and into the frame with a single bead of structural adhesive applied to the frame.

BRIEF DESCRIPTION OF THE DRAWINGS

FIG. 3 is a fragmentary, perspective view, on an enlarged scale, of a section of a perimeter frame of the outer shell.

FIG. 5 is a view similar to FIG. 4 showing the assembled condition of the frame and shell sheets.

FIG. 6 is a fragmentary, elevational, sectional view of a finished refrigeration cabinet assembly.

DESCRIPTION OF THE PREFERRED EMBODIMENT

Figure 1:
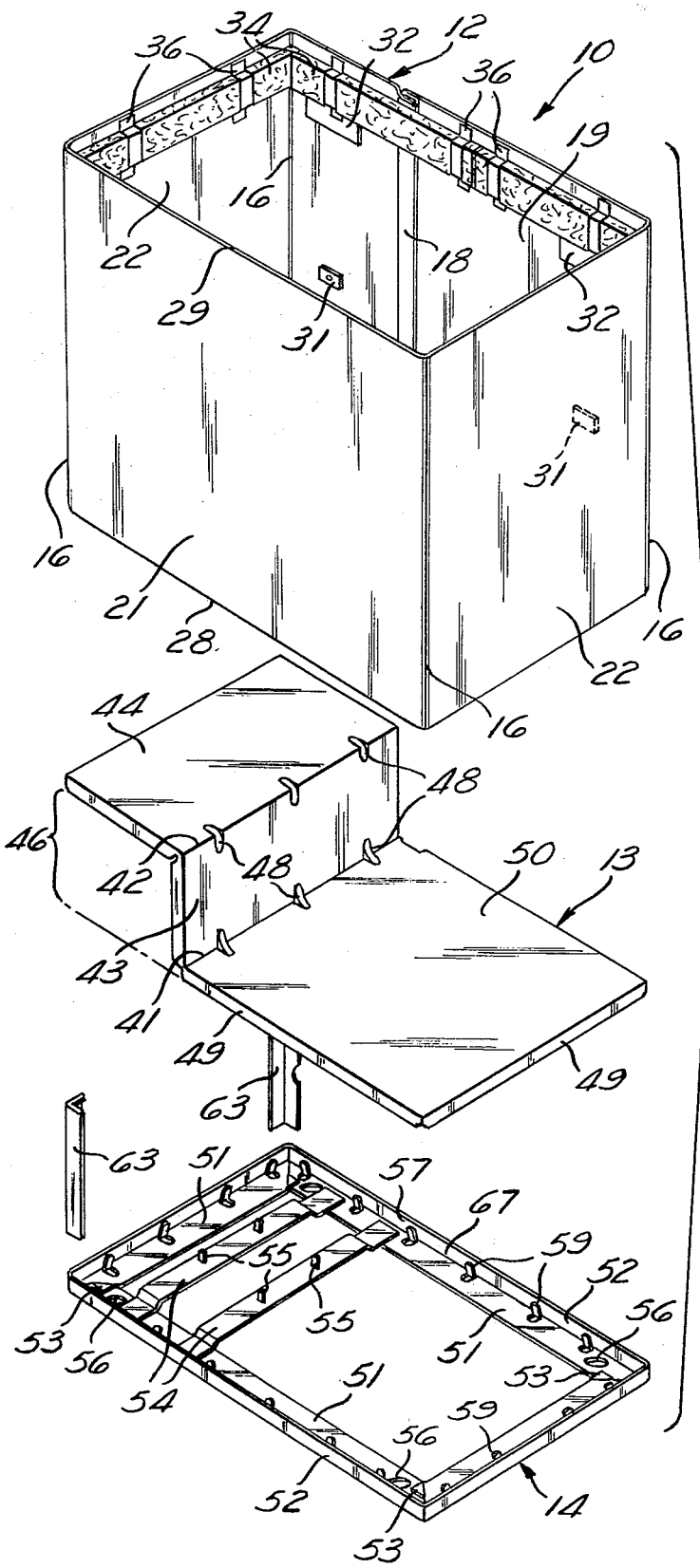
FIG. 1 is an exploded perspective view of an outer shell of a refrigeration cabinet constructed in accordance with the principles of the invention.
Figure 2:
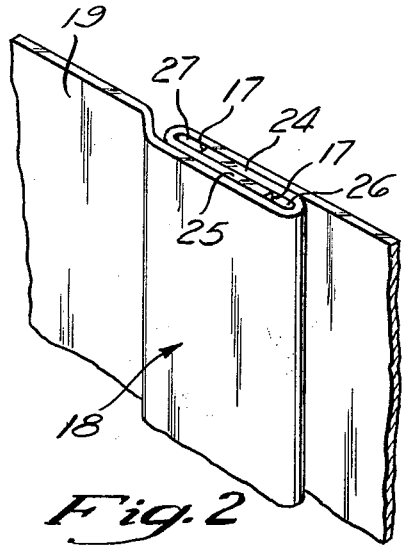
FIG. 2 is a fragmentary, perspective view, on an enlarged scale, of a portion of a wall seam formed by a sheet from which the outer shell is constructed.

FIG. 1 illustrates an outer shell assembly 10 for a refrigeration cabinet 11, such as that illustrated in FIG. 6. The shell assembly 10 includes a short, rectangular tube 12, an end wall 13, and a rigid perimeter frame 14. A top opening, domestic chest-type freezer cabinet 11 has been chosen to illustrate the invention. For the sake of convenience, the following description refers to the cabinet 11 in terms consistent with this particular arrangement wherein, for example, the frame 14 is disposed on the lower or bottom side of the shell assembly 10. It is to be understood, nevertheless, that the invention may be applied to other arrangements such as a vertical or upright cabinet.

The rectangular tube or sheet shell 12 is formed by bending up or wrapping an elongated, rectangular sheet such that its original far edges 17 are returned into a seam 18 at a mid-portion of a rear wall 19. As illustrated, this wall 19, an opposite parallel wall 21 and two perpendicular walls 22 are substantially planar and form right corners 16 at their intersections. The walls 19, 21, and 22 form four vertical exterior faces of the finished cabinet 11. Ideally, the seam 18 is mechanically formed by the sheet stock forming the tube 12 itself, preferably without additional parts, such as a channel, frame member, or fasteners, and without welding. The seam 18 is made by reverse folding the ends 24 and 25 of the sheet back on one one another to form interlocking grooves 26 and 27 in a construction commonly referred to as a "Pittsburgh flatlock seam." Remaining peripheral edges 28 and 29 of the shell tube 12 generally define planes of the fifth and sixth faces of the complete cabinet assembly 11.

The sheet forming the shell tube 12 is preferably prefinished metal stock, such as painted or plastic-coated steel or aluminum. Vinyl-coated steel is particularly suited for this application, and may be wrapped into the desired shape without significantly disturbing the appearance or protective effectiveness of the coating where it is stressed at the corners 16 upon bending. Use of such prefinished stock is more economical than the conventional practice of finishingg the cabinet panels after their final assembly. Moreover, a prefinished cabinet generally has a more uniform appearance and greater serviceability than may be had with a cabinet finished after assembly.

A number of spaced plates 31, 32 of steel or other rigid material are secured to the rear cabinet wall 19 by double-sided adhesive tape or other means. These plates 31, 32 are provided with pierced holes (not shown) for receiving screws for externally mounting hinges for a cabinet cover or lid 33 (FIG. 6) and an external condenser coil (not shown). A strip of fiberglass or other porous material 34 is fixed by adhesive tape 36 along the inner periphery of the shell tube 12 adjacent its upper edge 29 to permit air to escape through one or more holes in the rear wall 19 covered by the fiber glass when foam is expanded in the shell as discussed below.

The end wall panel 13, preferably formed of sheet metal, is stepped at right corners 41 and 42 with a riser portion 43 and a platform portion 44. The riser and platform portions 43 and 44 form with the frame 14 a cavity, indicated generally at 46, for reception therein of a motor compressor unit (not shown). A series of corner reinforcing ribs 48 are integrally stamped or otherwise formed on the end wall 13. The end wall 13 includes a peripheral flange 49 depending at right angles to the various planes of the end wall. The peripheral flange 49 serves to stiffen the end wall 13 and, as explained below, provides means for mounting a major portion 50 of the wall in the frame 14. The end wall 13 is dimensioned to fit in the shell tube 12 with a minimum of clearance so that it closes the associated end of the shell tube sufficiently to temporarily contain liquid components during foaming of rigid insulation, as discussed below.

The frame 14 is preferably performed of a continuous length of flat stock rolled into an angle having perpendicular legs or flanges 51 and 52. The angle leg 51 is notched, overlapped, and spot welded at four corners 53. Original ends of the stock are butted on the vertical flange 52 and overlapped on the horizontal or lower flange to form a joint 57 at inconspicuous points, such as the area immediately under the seam 18 of the shell tube 12. A pair of parallel cross members 54 are spot welded on the horizontal flange 51 and provide brackets 55 for mounting a motor compressor unit thereon. Holes 56 are provided adjacent the frame corners 53 for securing support legs or rollers to the lower side of the frame 14.

Referring particularly to FIG. 3, the horizontal frame flange 51 is stamped at spaced locations to form upstanding locating tabs 59. The integral stamped tabs 59 are inclined slightly with respect to the vertical frame flange 52 and cooperate with this flange to provide short grooves 61 (FIG. 4) for reception of the shell tube 12 and, at certain tabs, for reception of the flange 49 associated with the major portion 50 of the end wall. The frame 14 is ideally formed of steel and is painted or otherwise finished after the aforementioned spot welding and punching operations. A pair of vertical legs 63 are dimensioned to rest on the horizontal frame flange 51 and to vertically support the end wall platform portion 44 when the end wall 13 is assembled on the frame 14.

Figure 4:
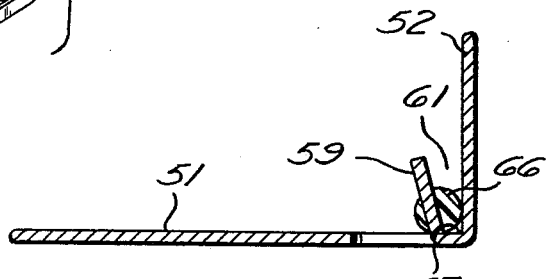
FIG. 4 is a cross sectional view of the perimeter frame illustrating at a typical location a preferred manner of applying a structural adhesive for securing the shell sheets to the frame.

The shell tube 12, end wall 13, and frame 14 are assembled by securing the tube and wall to the frame with a structural adhesive 66 of a commercially available type suitable for the particular materials from which these members are constructed. Ideally, a two-part adhesive is used so that a relatively short set time is achieved. Such adhesive 66 is applied as a continuous bead along the full length of the frame 14, adjacent or in an inner corner 67 (FIG. 4). After the adhesive bead 66 is applied, and before it has set, the lower tube edge 28 and depending flange 49 of the major end wall portion 50 are positioned in the grooves 61 formed by the tabs 59 and are seated on the lower flange 51. As seen in FIG. 5, the sheet edge 28 and flange 49 are thereby embedded in and commonly bonded to the frame 14 by the adhesive 66.

As suggested above, FIG. 6 shows the outer shell assembly 10 in a complete refrigeration cabinet 11. The refrigeration cabinet 11 includes an inner box-like liner 71 having dimensions somewhat smaller than the shell assembly 10. The liner 71 is spaced from the shell tube 12 and the end wall 13 to provide an insulating space therebetween. The liner 71 is positioned horizontally or laterally with respect to the shell assembly 10 by a thermal breaker collar 72. The breaker collar 72 has a channel or inverted U-shaped cross section, with each leg 73 and 74 having a panel receiving groove 75 and 76 for the walls of the liner 71 and the upper edge 29 of the shell tube 12 respectively. The breaker collar 72, ideally, is molded of a plastic material such as vinyl in an integral rectangular piece, with its outer dimensions substantially equal to those of the outer vertical flange 52 of the frame 14.

Rigid foam spacer blocks (not shown) may be set into the shell assembly 10 before the liner 71 is placed so as to support the liner vertically above its end wall 13 at the proper height relative to the shell. The breaker collar 72 is then installed on these components 10, 71. With the shell assembly 10 externally supported in a fixture and a plug internally supporting the liner 71 in accordance with conventional practices, liquid foam components are injected into the space between the shell assembly and liner through a suitable hole in one of these members to react and form rigid insulating foam 79 throughout this space.

The foam 79 is preferably a low density, closed cell polyurethane foam of the type in common use in refrigeration devices. Such foam exhibits relatively high strength for its low density and substantial adhesion to materials such as steel or aluminum. Both the rigidity of the foam 79 and its adhesion to the liner 71 and shell 10 produce a sandwich construction which is surprisingly strong and rigid even when relatively light gauge sheet stock is used in the formation of the liner 71 and/or shell tube 12. The interlocked construction of the shell seam 18 is such that it becomes tightly engaged and self-locking when subjected to tension in the plane of the wall 19. Expansion of the foam 79 in the shell thereby assures a tight seam. Moreover, when the foam 79 solidifies, accidental separation of the seam 18 is prevented, since the foam resists compression forces along the plane of the wall 19.

It is generally not necessary to prefinish the shell tube 12 or liner 71 on their interior surfaces, since these surfaces are not visible and are protected from oxidation by the foam 79. The foam 79 permanently adheres to the breaker collar 72 to prevent its accidental removal from the liner 71 and shell 10. The cabinet door or lid 33 is preferably provided with a balloon-type elastic peripheral seal 81 to the seal on the thermal breaker collar 72.

Although a preferred embodiment of this invention is illustrated, it is to be understood that various modifications and rearrangements of parts may be resorted to without departing from the scope of the invention disclosed and claimed herein. For example, the principles of the invention may be readily adapted to a vertical cabinet construction over the cabinet door provided on a vertical face of the cabinet.

What is claimed is:

1. In a refrigeration cabinet, an outer shell comprising four sidewalls, each sidewall perpendicular to its adjacent ones, said sidewalls being formed of a single continuous sheet, a rectangular inner liner within said outer sheet having dimensions smaller than the outer shell to thereby provide an insulating space therebetween, two edges of said sheet having integral means forming a self-made mechanical seam, said integral seam means including self-locking means resisting forces tending to separate said seam, said self-locking means including a reverse fold of material at each of said edges, said folds being interlocked with one another, and a layer of rigid insulating foam foamed in place in said insulating space on the interior of said sheet along each of said sidewalls, said foam substantially filling said space and preventing separation of said folds under compressive forces along the plane of a sidewall associated with said seam and opening of said folds out of the plane of the sidewall, said sidewalls each being substantially continuous and imperforate in their respective planes and forming along one edge a plane of a fifth side adapted to provide an access door into the insulated interior of said cabinet.

2. A cabinet as set forth in claim 1, wherein said seam is provided in a mid-portion of said associated sidewalls.

3. A refrigeration cabinet with six rectangular, exterior faces comprising an outer shell including a continuous sheet forming cabinet sidewalls at four of said faces and integral corners between said sidewalls, two edges of said sheet being joined at a seam parallel to said corners, a rectangular rigid frame along another edge of the sheet at the perimeter of a fifth cabinet face, and means for securing said sidewalls to said frame without disturbing the external appearance of said sidewalls whereby said sheet may be prefinished with an appearance coating prior to being secured to said frame, the sixth cabinet face opposite said frame being open to permit access into said cabinet and adapted to be closed by a movable cover, said frame including a flange portion extending outward of and parallel to the planes of said sidewalls lengthwise along substantially the full extent of said other sheet edge and widthwise over an area of said sidewalls in their respective planes, whereby said sidewalls are externally supported adjacent said fifth face by said frame.

4. A cabinet as set forth in claim 3, wherein said securing means includes sheet edge receiving groove means on said frame.

5. A cabinet as set forth in claim 4, wherein said sidewalls are retained in said groove means by an adhesive between said frame and said sheet edge.

6. A refrigeration cabinet with six rectangular, exterior faces comprising an outer shell including a continuous sheet forming cabinet sidewalls at four of said faces and integral corners between said sidewalls, two edges of said sheet being joined at a seam parallel to said corners, a rectangular rigid frame along another edge of the sheet at the perimeter of a fifth cabinet face, and means for securing said sidewalls to said frame without disturbing the external appearance of said sidewalls whereby said sheet may be prefinished with an appearance coating prior to being secured to said frame, the sixth cabinet face opposite said frame being open to permit access into said cabinet and adapted to be closed by a movable cover, said frame including a flange portion extending outward of and parallel to the planes of said sidewalls along substantially the full extent of said other sheet edge, whereby said sidewalls are externally supported adjacent said fifth face by said frame, said securing means including sheet edge receiving groove means on said frame, said frame being formed of flat stock into an angle, one leg of said angle providing said outwardly extending frame portion, said groove means being formed by said one leg and spaced tabs stamped out of the other leg of said angle.

7. A refrigeration cabinet with six rectangular, exterior faces comprising an outer shell including a continuous sheet forming cabinet sidewalls at four of said faces and integral corners between said sidewalls, two edges of said sheet being joined at a seam parallel to said corners, a rectangular rigid frame along another edge of the sheet at the perimeter of a fifth cabinet face, and means for securing said sidewalls to said frame without disturbing the external appearance of said sidewalls whereby said sheet may be prefinished with an appearance coating prior to being secured to said frame, the sixth cabinet face opposite said frame being open to permit access into said cabinet and adapted to be closed by a movable cover, said frame including a flange portion extending outward of and parallel to the planes of said sidewalls along substantially the full extent of said other sheet edge, whereby said sidewalls are externally supported adjacent said fifth face by said frame, said securing means including sheet edge receiving groove means on said frame, said outer shell including an end wall at the cabinet face associated with said frame, said end wall being formed of sheet material and having areas extending into said sheet edge receiving groove means.

8. A cabinet assembly as set forth in claim 7, wherein said end wall areas and said sidewall portions are secured together and in said grooves by a common adhesive.

9. A refrigeration cabinet assembly comprising an outer shell, said shell including a rectangular tube formed of a continuous wrapped sheet having a pair of its ends returned to a seam, a shell sheet end wall closing off one end of the shell tube, said end wall having a depending peripheral flange, a rectangular rigid frame formed of flat stock into an angle, one angle leg of said frame externally supporting one end of said tube, the other angle leg of said frame being perforated at spaced locations to provide locating tabs, said locating tabs forming grooves with said one angle leg, said one tube end and said end wall flange being positioned in said grooves, an open-ended box-like inner liner having dimensions somewhat smaller than said shell tube, said liner being positioned in and spaced from said shell tube with its open end adjacent the other end of said shell tube, and rigid polyurethane foam foamed in place between the liner and shell whereby said foam adheres to and supports said liner and shell in a sandwich-like construction.

* * * * *